US005681176A

United States Patent [19]

Ibaraki et al.

[11] Patent Number: 5,681,176

[45] Date of Patent: Oct. 28, 1997

[54] HINGE CONNECTOR SUITABLE FOR USE IN A HINGE PORTION INCLUDED IN AN ELECTRONIC DEVICE

[75] Inventors: Kazuaki Ibaraki; Katsuma Ushijima; Michio Nagai; Yuichi Morita, all of Tokyo; Koji Umeda, Saitama, all of Japan

[73] Assignee: NEC Corporation, Tokyo, Japan

[21] Appl. No.: 565,415

[22] Filed: Nov. 30, 1995

[30] Foreign Application Priority Data

Dec. 5, 1994 [JP] Japan ..... 6-301143
Sep. 8, 1995 [JP] Japan ..... 7-231789

[51] Int. Cl.[6] ..... H01R 35/00

[52] U.S. Cl. ..... 439/165; 439/31

[58] Field of Search ..... 439/165, 15, 31, 439/162, 164, 587, 588, 589, 492, 499, 498; 16/221, 223, 356, 392

[56] References Cited

U.S. PATENT DOCUMENTS

| | | | |
|---|---|---|---|
| 3,727,168 | 4/1973 | Henschen et al. | 439/498 |
| 3,857,625 | 12/1974 | Crane et al. | 439/31 |
| 4,140,357 | 2/1979 | Wolz et al. | 439/31 |
| 4,241,965 | 12/1980 | Wilson et al. | 439/207 |
| 4,825,395 | 4/1989 | Kinser et al. | 364/708 |
| 4,921,432 | 5/1990 | Ferree | 439/164 |
| 4,961,126 | 10/1990 | Suzuki | 439/164 |
| 5,132,492 | 7/1992 | Wieder | 174/65 |
| 5,203,723 | 4/1993 | Ritter | 439/589 |
| 5,237,488 | 8/1993 | Moser et al. | 439/31 |
| 5,266,048 | 11/1993 | Brekosky et al. | 439/492 |
| 5,278,725 | 1/1994 | Konno et al. | 439/165 |
| 5,387,125 | 2/1995 | Davis et al. | 439/497 |

FOREIGN PATENT DOCUMENTS

| | | | |
|---|---|---|---|
| 2 170 058 | 7/1986 | United Kingdom | H01R 13/58 |
| 2 238 186 | 5/1991 | United Kingdom | H02G 15/14 |
| 2 269 587 | 2/1994 | United Kingdom | C02F 1/68 |
| WO 95/13665 | 5/1995 | WIPO | H01R 39/00 |

*Primary Examiner*—Gary F. Paumen
*Assistant Examiner*—T. C. Patel

[57] ABSTRACT

A hinge connector includes a pair of tubular members. Each of the tubular members has a tubular section formed with a hollow portion, and a fitting section formed with a receiving space for receiving a counterpart connector. The tubular members are coupled with each other so as to be turnable relative to each other. The hinge connector further includes a flexible conductor. The flexible conductor has connect portions at its both ends and a flexible intermediate portion connecting the connect portions. The flexible intermediate portion of the conductor is turned and arranged in the hollow portions of the tubular sections, while the connect portions thereof are disposed in the corresponding receiving spaces of the fitting sections so as to be connected to the corresponding counterpart connectors, respectively.

11 Claims, 14 Drawing Sheets

HINGE CONNECTOR SUITABLE FOR USE IN A HINGE PORTION INCLUDED IN AN ELECTRONIC DEVICE

BACKGROUND OF THE INVENTION

The present invention relates to a connector suitable for use in an electronic device including a plurality of boxes and a hinge portion mechanically connecting between adjacent ones of the boxes. Such a connector will be called a hinge connector throughout the specification.

In an electronic device such as a portable telephone or a personal computer, two boxes are arranged to turn relative to each other as regards a hinge portion and are provided with electronic circuits mounted on circuit boards, respectively. Usually, it is necessary to electrically connect between the electric circuits through the hinge portion.

In general, a flexible flat conductor member, such as a flexible printed circuit board or a flexible flat cable, is used for electrically connecting between the electric circuits of the electronic device. In the manner known in the art, the flexible flat conductor member comprises a plurality of conductive electric wires arranged along a flat surface and an insulation member collectively covering the electric wires. Specifically, the electric wires are directly soldered to the circuit boards, respectively, so as to achieve connection between the electric circuits. Alternatively, connectors are attached to the boxes, respectively, and these connectors are connected by the flexible flat conductor member.

In recent years, the electric devices have been reduced in size, increased in density and advanced to be multifunctional. Following this, a number of signals handled by the flexible flat conductor member has been increased. Thus pitches of contacts included in each of these connectors have been narrowed.

However, due to the narrowing of the pitches of the contacts, it has been difficult to assemble the device. Further, it has been difficult to protect a connecting portion of each of the electric wires from the surrounding atmosphere. Moreover, a waterproof arrangement could not be achieved.

SUMMARY OF THE INVENTION

It is therefore an object of the present invention to provide a hinge connector which is suitable for use in a hinge portion included in an electronic device.

It is another object of this invention to provide a hinge connector of the type described, which can be readily assembled in a case where the hinge connector is designed in a small size.

It is still another object of this invention to provide a hinge connector of the type described, in which a connecting portion of each of the electric wires can be readily protected from the surrounding atmosphere to have a waterproof arrangement.

Other objects of this invention will become clear as the description proceeds.

According to an aspect of the present invention, a hinge connector comprises a first tubular member having a first tubular section and a first fitting section, the first tubular section having a first hollow portion, the first fitting section having a first receiving space for receiving a first counterpart connector; a second tubular member having a second tubular section and a second fitting section and coupled with the first tubular member so that the first and the second tubular members are turnable relative to each other, the second tubular section having a second hollow portion, the second fitting section having a second receiving space for receiving a second counterpart connector, and a flexible conductor arranged in the first and the second hollow portions, the flexible conductor having at its one end a first connect portion disposed in the first receiving space and connected to the first counterpart connector and at its other end a second connect portion disposed in the second receiving space and connected to the second counterpart connector.

According to another aspect of the present invention, a hinge connector comprises a first tubular member having a first tubular section and a first receiving space, the first tubular section having a first hollow portion, the first receiving space receiving a first fitting member to be engaged with a first counterpart connector, a second tubular member having a second tubular section and a second receiving space and coupled with the first tubular member so that the first and the second tubular members are turnable relative to each other, the second tubular section having a second hollow portion, the second receiving space receiving a second fitting member to be engaged with a second counterpart connector; and a flexible conductor arranged in the first and the second hollow portions, the flexible conductor having at its one end a first connect portion coupled with the first fitting member and at its other end a second connect portion coupled with the second fitting member, the first and the second connect portions having conductive contacts to be connected to the first and the second counterpart connectors, respectively.

BRIEF DESCRIPTION OF THE DRAWINGS

FIGS. 10A and 10B are diagrams showing a hinge connector according to a second preferred embodiment of the present invention, wherein FIG. 10A shows an opened state of the hinge connector, while FIG. 10B shows a closed state of the hinge connector;

FIGS. 12A, 12B and 12C are diagrams, respectively, for explaining a structure of one of two tubular members which form the hinge connector according to the second preferred embodiment, wherein FIG. 12A is a front view, FIG. 12B is a left-side view of FIG. 12A and FIG. 12C is a left-side view of FIG. 12B;

FIGS. 14A, 14B and 14C are diagrams, respectively, for explaining a structure of the other of the tubular members which form the hinge connector according to the second preferred embodiment, wherein FIG. 14A is a front view, FIG. 14B is a right-side view of FIG. 14A and FIG. 14C is a right-side view of FIG. 14B;

FIGS. 18A and 18B are diagrams, respectively, showing the flexible printed circuit boards along with the fitting members coupled to the flexible printed circuit boards, wherein FIG. 18A is a plan view and FIG. 18B is a rear view of FIG. 18A;

FIGS. 21A and 21B are diagrams showing the modification of the hinge connector, wherein FIG. 21A is a perspective view showing the flexible printed circuit board shown in FIG. 16 coupled with one-side fitting members, and FIG. 21B is a reversed perspective view of FIG. 21A; and FIGS. 22A, 22B and 22C are diagrams, respectively, showing a counterpart connector to be connected to the hinge connector shown in FIGS. 10A and 10B, wherein FIG. 22A is a plan view, FIG. 22B is a front view and FIG. 22C is an enlarged sectional view taken along line A—A in FIG. 22B.

DESCRIPTION OF THE PREFERRED EMBODIMENTS

Now, preferred embodiments of the present invention will be described hereinbelow with reference to the drawings.

Figure 1:
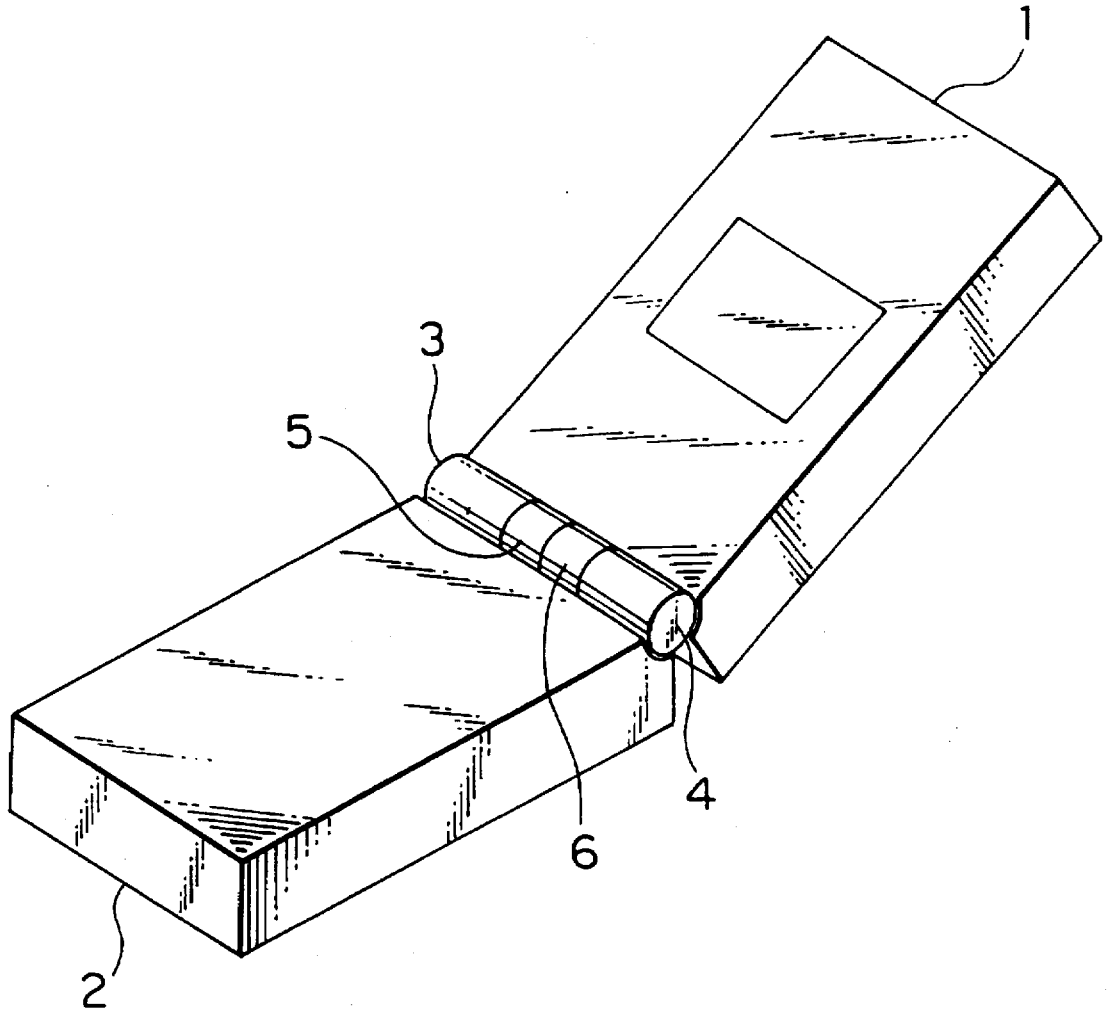
FIG. 1 is a perspective view showing an electronic device including a hinge connector according to a first preferred embodiment of the present invention.

FIG. 1 is a perspective view showing a portable electronic device including a hinge connector according to a first preferred embodiment of the present invention. In FIG. 1, the device includes two boxes 1 and 2 which are coupled by hinges 3 and 4 so as to be turnable relative to each other. Between the hinges 3 and 4 are interposed two tubular members 5 and 6 which form the hinge connector according to this embodiment.

Figure 2:
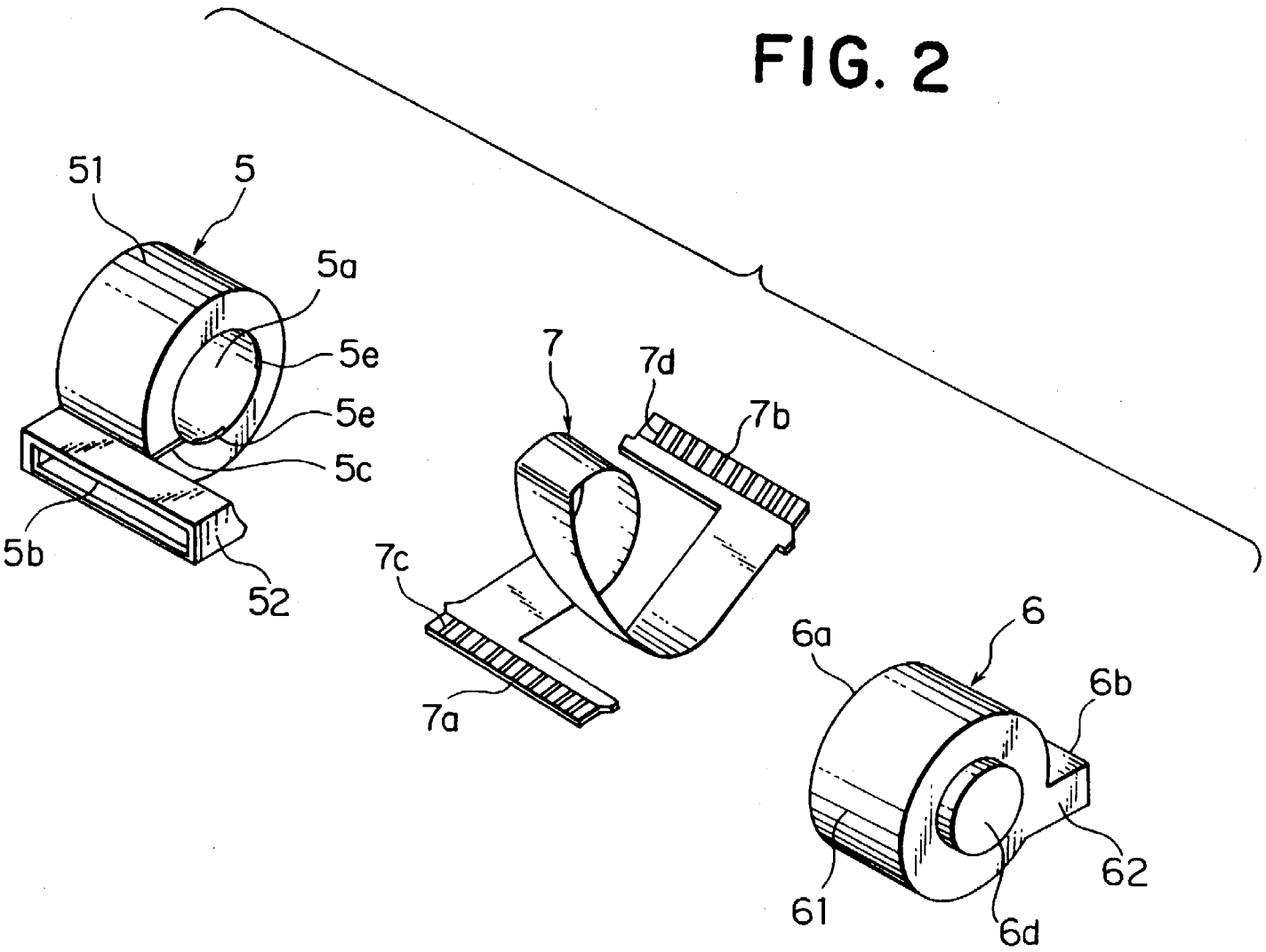
FIG. 2 is an exploded perspective view showing a structure of the hinge connector according to the first preferred embodiment.

FIG. 2 is an exploded view showing a structure of the hinge connector. The hinge connector is formed by the tubular members 5 and 6 and a flexible printed circuit board (which will be called an FPC hereinunder) 7 as an example of a flexible conductor. In the manner known in the art, the FPC 7 comprises a plurality of conductive electric wires which are arranged along a flat surface and collectively covered by an insulation member.

Figure 3A:
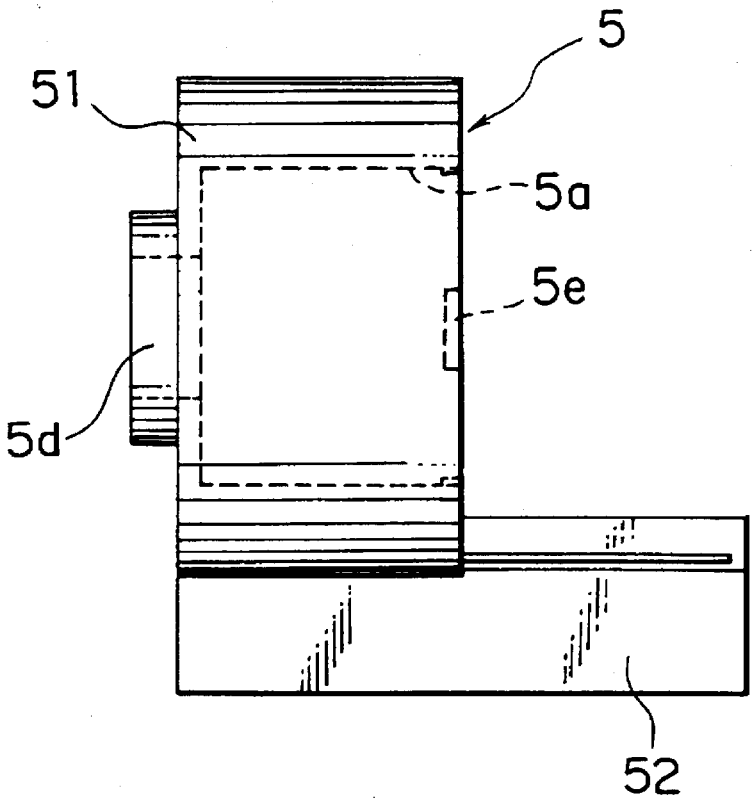
FIGS. 3A and 3B are diagrams, respectively, for explaining a structure of one of two tubular members which form the hinge connector according to the first preferred embodiment.
Figure 3B:
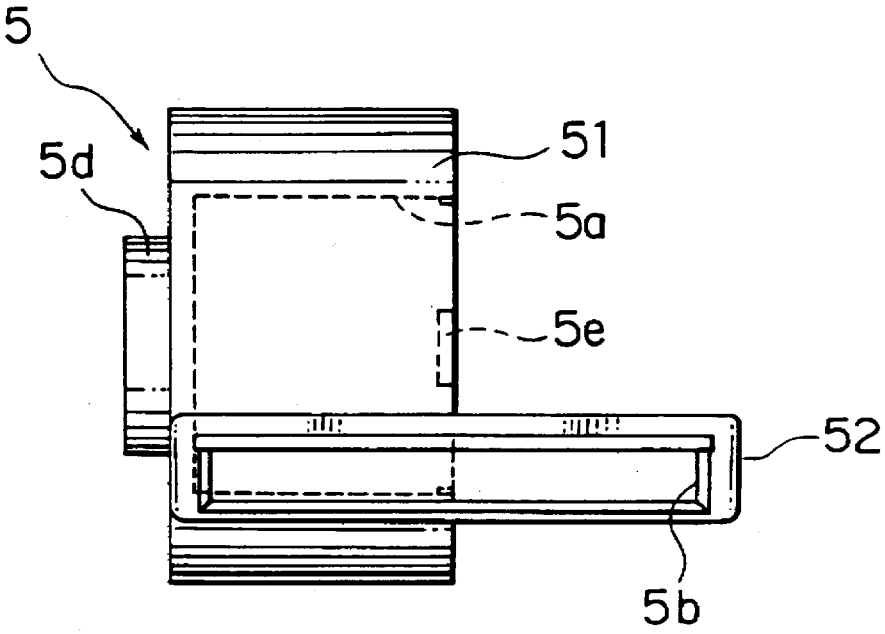

The tubular member 5 is made of insulation material and includes a tubular section 51 having a hollow portion 5*a* and a fitting section 52 having a receiving space 5*b*. The tubular section 51 is further formed with an opening 5*c* which is continuous with the hollow portion 5*a*. The receiving space 5*b* receives therein a connector provided at a circuit section arranged within one of the boxes 1 and 2, for example, the box 2. As shown in FIGS. 3A and 3B, engaging pieces 5*e* are formed at regular intervals inside the hollow portion 5*a*, that is, on a wall defining the hollow portion 5*a*. Further, a tubular projection 5*d* is formed on a side of the tubular section 51 opposite to a side thereof where the hollow portion 5*a* is formed. The engaging pieces 5*e* engage with a later-described annular projection 6*e* of the tubular member 6 so that the tubular members 5 and 6 are coupled to be turnable relative to each other. The tubular projection 5*d* engages with a corresponding recess of the hinge 3 so that the tubular member 5 and the hinge 3 are coupled to be turnable relative to each other.

Figure 4:
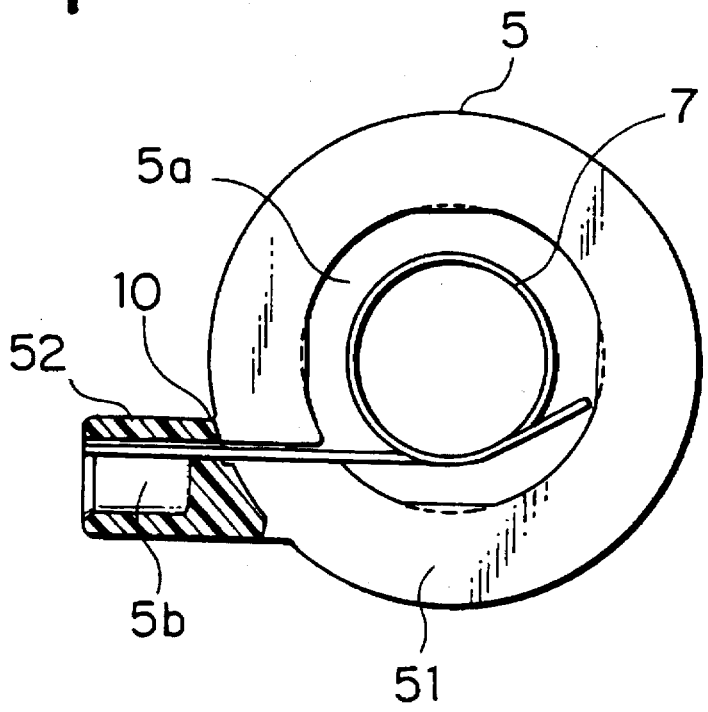
FIG. 4 is a partly-sectioned view showing the state wherein a flexible printed circuit board is incorporated in the tubular member shown in FIGS. 3A and 3B.
Figure 5:
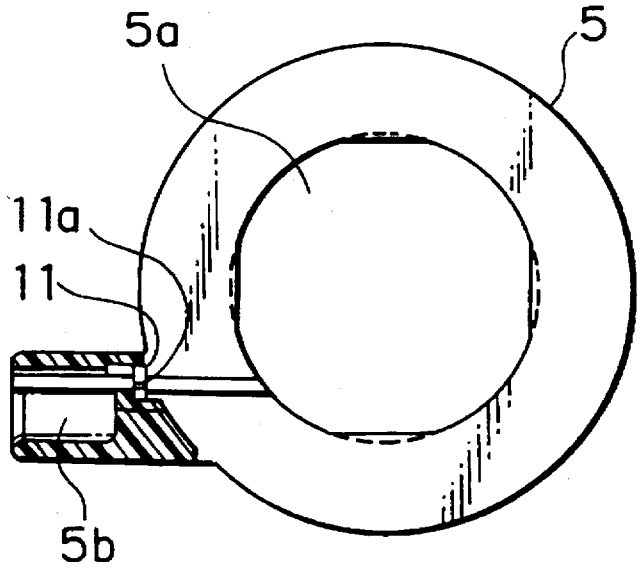
FIG. 5 is a partly-sectioned view of the tubular member shown in FIGS. 3A and 3B, wherein a packing is used instead of an adhesive for providing a waterproof arrangement.

As shown in FIG. 4, an adhesive 10 is applied between the tubular section 51 and the fitting section 52 within the tubular member 5 so as to seal the fitting section 52 relative to the tubular section 51 to provide a waterproof arrangement for the fitting section 52. This sealing with the adhesive 10 is performed after incorporating the FPC 7 inside the tubular member 5 as shown. As shown in FIG. 5, a packing 11 formed of rubber or the like may be disposed between the tubular section 51 and the fitting section 52 instead of the adhesive 10 so as to achieve a waterproof arrangement similar to that achieved by the adhesive 10. When using the packing 11, by providing an opening 11*a* in the packing 11 for insertion of the FPC 7, the FPC 7 can be mounted in the tubular member 5 in the state where the packing 11 is incorporated in advance in the tubular member 5, as appreciated from FIG. 5.

Figure 6A:
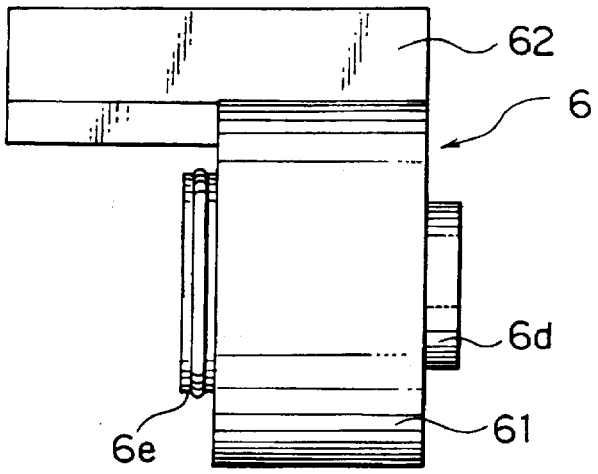
FIGS. 6A, 6B and 6C are diagrams, respectively, for explaining a structure of the other of the tubular members which form the hinge connector according to the first preferred embodiment.
Figure 6B:
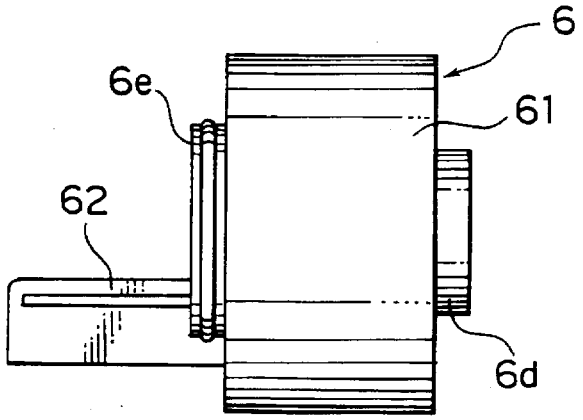
Figure 6C:
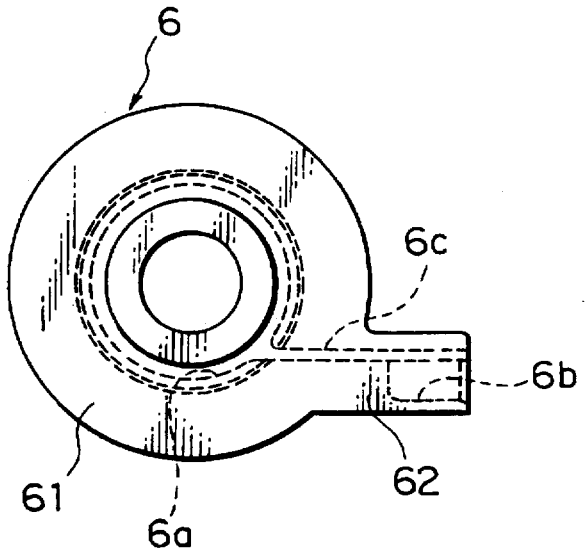

As shown in FIGS. 6A, 6B and 6C, the tubular member 6 is made of insulation material and includes a tubular section 61 having a hollow portion 6*a* and an opening 6*c* continuous with the hollow portion 6*a*, and a fitting section 62 having a receiving space therein. The receiving space 6*b* receives therein a connector provided at a circuit section arranged within the other of the boxes 1 and 2, for example, the box 1. The tubular section 61 is formed with the annular projection 6*e*, on a side of the tubular section 61 where the hollow portion 6*a* is formed, to be engaged with the engaging pieces 5*e* of the tubular member 5. Further, a tubular projection 6*d* is formed on a side of the tubular section 61 opposite to the side thereof where the hollow portion 6*a* is formed. The tubular projection 6*d* engages with a corresponding recess of the hinge 4 so that the tubular member 6 and the hinge 4 are coupled to be turnable relative to each other. Although not shown in FIGS. 6A to 6C, a waterproof arrangement for the fitting section 62 is also provided as in the tubular member 5 using the adhesive or packing.

Figure 7:
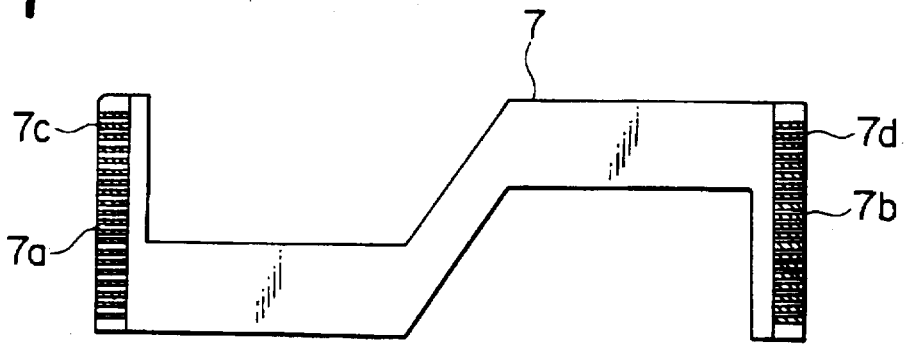
FIG. 7 is a diagram for explaining a structure of a flexible printed circuit board forming the hinge connector according to the first preferred embodiment, wherein the flexible printed circuit board is shown in the state before being turned.

As shown in FIG. 7, the FPC 7 has connect portions 7*a* and 7*b* at its both ends. An intermediate portion of the FPC 7 extending between the connect portions 7*a* and 7*b* is flexible or bendable. The connect portion 7*a* is connected to the connector provided at the circuit section arranged inside one of the boxes 1 and 2, for example, the box 2. On the other hand, the connect portion 7b is connected to the connector provided at the circuit section arranged, for example, inside the box 1. As appreciated, the intermediate portion of the FPC 7 is provided with conductors for electrically connecting the connect portions 7a and 7b. At the connect portions 7a and 7b, a number of contacts 7c and 7d are arranged at given narrow pitches, respectively.

As shown in FIG. 2, the FPC 7 is mounted in the tubular members 5 and 6 in the state where the intermediate portion thereof is bent or turned. In the mounted state, the intermediate portion of the FPC 7 is arranged inside the hollow portions 5a and 6a of the tubular members 5 and 6. Further, the connect portion 7a is arranged in one of the receiving spaces 5b or 6b, for example, the receiving space 5b. On the other hand, the connect portion 7b is arranged in the other receiving space 6b. The FPC 7 may be replaced with a flexible flat cable (FFC) or the like. In the manner known in the art, the flexible flat cable comprises a plurality of conductive electric wires which are arranged parallel to one another along a flat surface and collectively covered by an insulation member.

Figure 8:
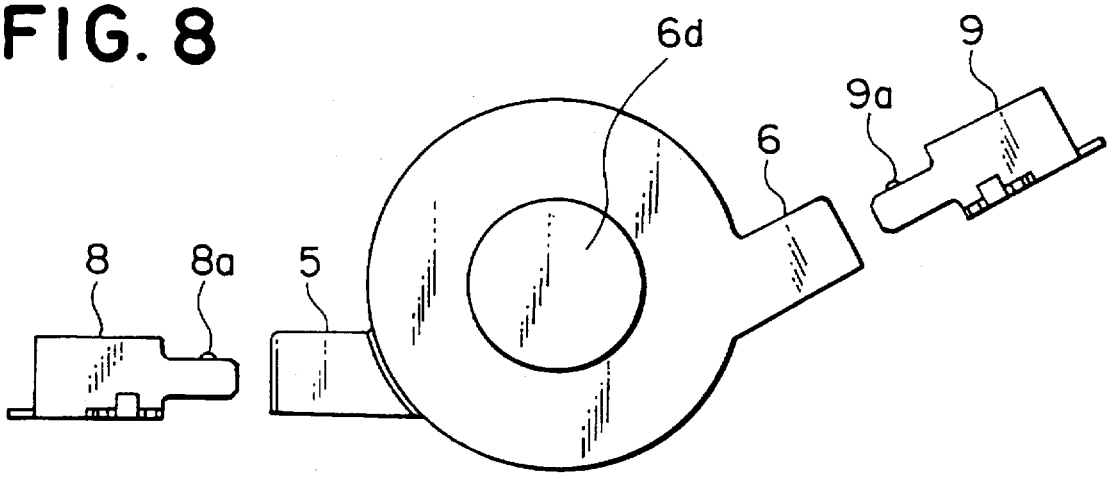
FIG. 8 is a diagram showing the state before the hinge connector is coupled with connectors provided at corresponding boxes, according to the first preferred embodiment.
Figure 9:
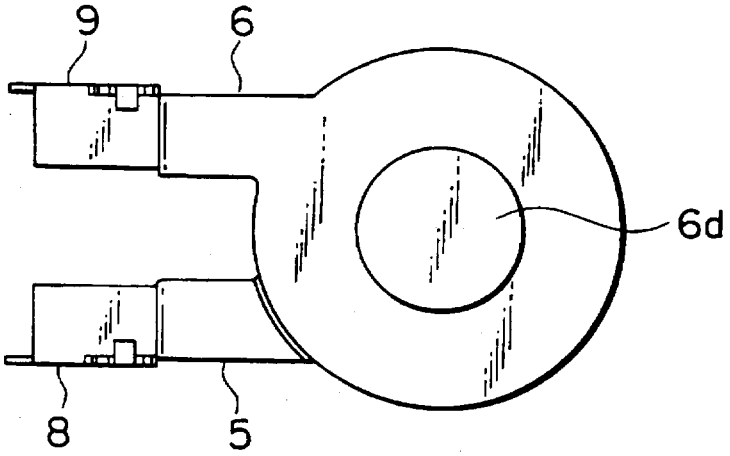
FIG. 9 is a diagram showing the state wherein the hinge connector is coupled to the connectors provided at the corresponding boxes and then turned.

As appreciated from FIG. 8, the hinge connector having the FPC 7 mounted in the tubular members 5 and 6 is connected to the connectors 8 and 9 which are attached to circuit substrates or the like forming the circuit sections of the boxes 2 and 1, respectively. The connectors 8 and 9 are provided with a number of contacts 8a and 9a to be in contact with the contacts 7c and 7d of the connect portions 7a and 7b of the FPC 7. FIG. 9 shows the state wherein the hinge connector is turned after receiving the connectors 8 and 9 in the receiving spaces 5b and 6b of the fitting sections 52 and 62.

Now, a second preferred embodiment of the present invention will be described hereinbelow.

Figure 10A:
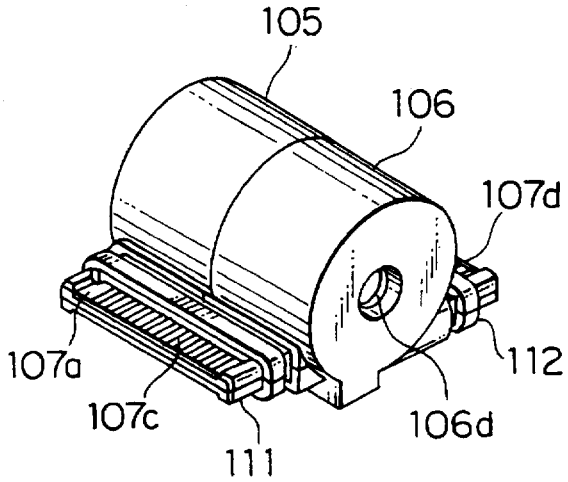
Figure 10B:
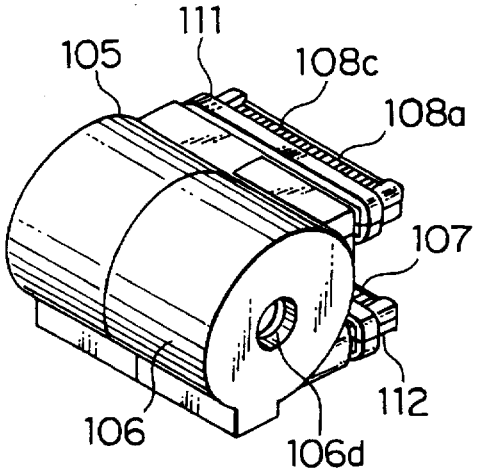

FIGS. 10A and 10B show a hinge connector according to the second preferred embodiment, wherein FIG. 10A shows an opened state of the hinge connector, while FIG. 10B shows a closed state of the hinge connector. As appreciated, the hinge connector of this embodiment may also apply to the portable electronic device shown in FIG. 1 instead of the hinge connector of the foregoing first preferred embodiment. As shown in FIGS. 10A and 10B, the hinge connector includes a pair of tubular members 105 and 106 which correspond to the tubular members 5 and 6 of the foregoing first preferred embodiment.

Figure 11:
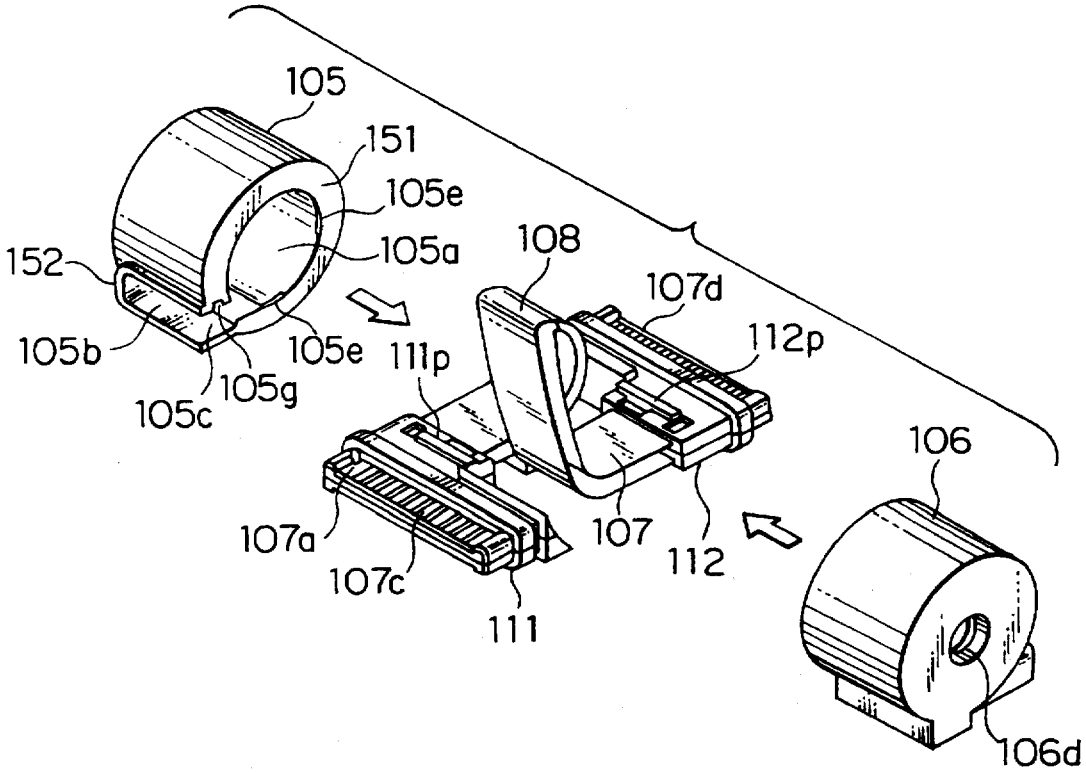
FIG. 11 is an exploded perspective view showing a structure of the hinge connector according to the second preferred embodiment.

FIG. 11 is an exploded view showing a structure of the hinge connector. The hinge connector is formed by the tubular members 105 and 106, two FPC's 107 and 108 each being a flexible conductor, and insulating fitting members 111 and 112 for uniting the respective ends of the FPC's 107 and 108.

The tubular member 105 includes a tubular section 151 having a hollow portion 105a, and a receiving section 152 having a receiving space 105b for receiving therein the fitting member 111. The receiving space 105b communicates with the hollow portion 105a. The receiving section 152 is slightly protruded from the outer circumference of the tubular section 151. The receiving space 105b extends to an open end of the hollow portion 105a so as to form an opening 105c. The fitting member 111 is inserted into the receiving space 105b via the opening 105c and coupled with the receiving section 152 by a half of the entire length of the fitting member 111 being press-fitted in the receiving section 152. The fitting member 111 is fitted to a counterpart connector attached to the circuit substrate provided inside one of the boxes 1 and 2 shown in FIG. 1, for example, the box 2, so as to be detachably connected to the counterpart connector.

Figure 12A:
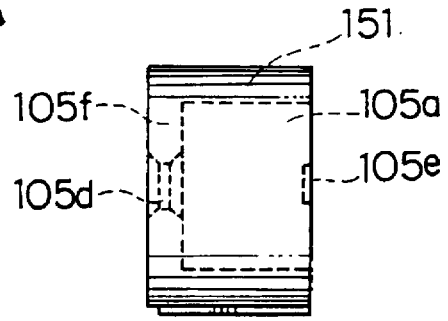
Figure 12B:
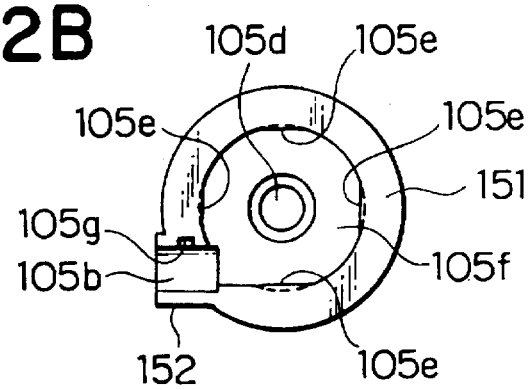
Figure 12C:
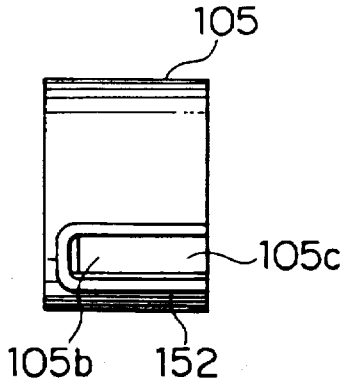
Figure 13:
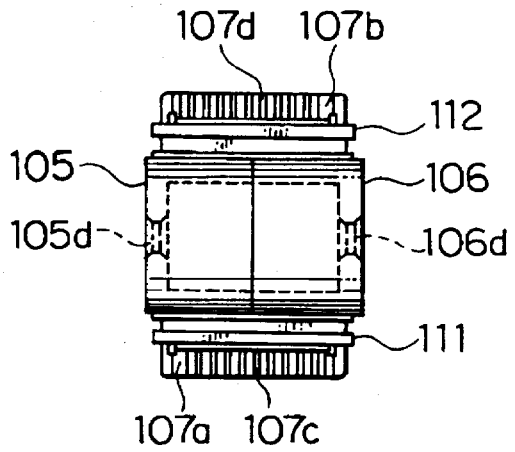
FIG. 13 is a plan view of the hinge connector shown in FIG. 10.

As shown in FIGS. 12A and 12B, a plurality of engaging pieces 105e are provided inside the hollow portion 105a, that is, on a circumferential wall defining the hollow portion 105a, at its open end at given intervals in a circumferential direction thereof. The engaging pieces 105e engage with a later-described annular projection 106e of the tubular member 106 so that the tubular members 105 and 106 are coupled together so as to be turnable relative to each other.

The tubular section 151 is formed with a closure wall 105f on a side opposite to the open end of the hollow portion 105a. The closure wall 105f is formed at its center with an engaging portion 105d in the form of a hole penetrating the closure wall 105f. The engaging portion 105d engages with a corresponding convex portion of the hinge 3 shown in FIG. 1 so that the tubular member 105 and the hinge 3 are coupled together so as to be turnable relative to each other.

As shown in FIGS. 12A and 12B, a plurality of engaging pieces 105e are provided inside the hollow portion 105a, that is, on a circumferential wall defining the hollow portion 105a, at its open end at given intervals in a circumferential direction thereof. The engaging pieces 105e engage with a later-described annular projection 106e of the tubular member 106 so that the tubular members 105 and 106 are coupled together so as to be turnable relative to each other.

The tubular section 151 is formed with a closure wall 105f on a side opposite to the open end of the hollow portion 105a. The closure wall 105f is formed at its center with an engaging portion 105d in the form of a hole penetrating the closure wall 105f. The engaging portion 105d engages with a corresponding convex portion of the hinge 3 shown in FIG. 1 so that the tubular member 105 and the hinge 3 are coupled together so as to be turnable relative to each other.

As shown in FIGS. 13 and 14A to 14C, the tubular member 106 includes a tubular section 161 having a hollow portion 106a, and a receiving section 162 having a receiving space 106b for receiving the fitting member 112. The receiving space 106b communicates with the hollow portion 106a. The receiving section 162 is slightly protruded from the outer circumference of the tubular section 161. The receiving space 106b extends to an open end of the hollow portion 106a so as to form an opening 106c. The fitting member 112 is inserted into the receiving space 106b via the opening 106c and coupled with the receiving section 162 by a half of the entire length of the fitting member 112 being press-fitted in the receiving section 162. The fitting member 112 is fitted to a counterpart connector attached to the circuit substrate provided inside the other of the boxes 1 and 2 shown in FIG. 1, for example, the box 1, so as to be detachably connected to the counterpart connector.

The tubular member 6 is formed with the annular projection 106e at the open end of the hollow portion 106a. As described before, the annular projection 106e engages with the engaging pieces 105e of the tubular member 105 so that the tubular members 105 and 106 are coupled together so as to be turnable relative to each other.

The tubular section 161 is formed with a closure wall 106f on a side opposite to the open end of the hollow portion 106a. The closure wall 106f is formed at its center with an engaging portion 106d in the form of a through hole penetrating the closure wall 106f. The engaging portion 106d engages with a corresponding convex portion of the hinge 4 shown in FIG. 1 so that the tubular member 106 and the hinge 4 are coupled together so as to be turnable relative to each other.

Figure 15:
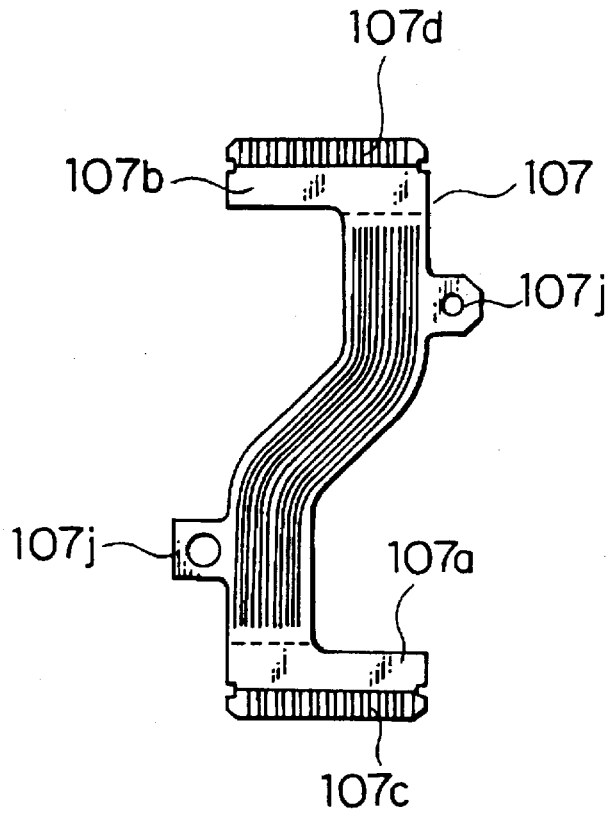
FIG. 15 is a plan view showing one of two flexible printed circuit boards forming the hinge connector according to the second preferred embodiment.

As shown in FIG. 15, the FPC 107 has connect portions 107*a* and 107*b* at its both ends. An intermediate portion extending between the connect portions 107*a* and 107*b* is flexible or bendable. The connect portion 107*a* is connected to the counterpart connector provided at the circuit section inside one of the boxes 1 and 2 shown in FIG. 1, for example, the box 2. On the other hand, the connect portion 107*b* is connected to the counterpart connector provided at the circuit section inside the other box 1. A number of contacts 107*c* and 107*d* are arranged at the connect portions 107*a* and 107*b* at given narrow pitches. As appreciated, the intermediate portion of the FPC 107 is provided with conductors for connection between the contacts 107*c* and 107*d*.

Figure 16:
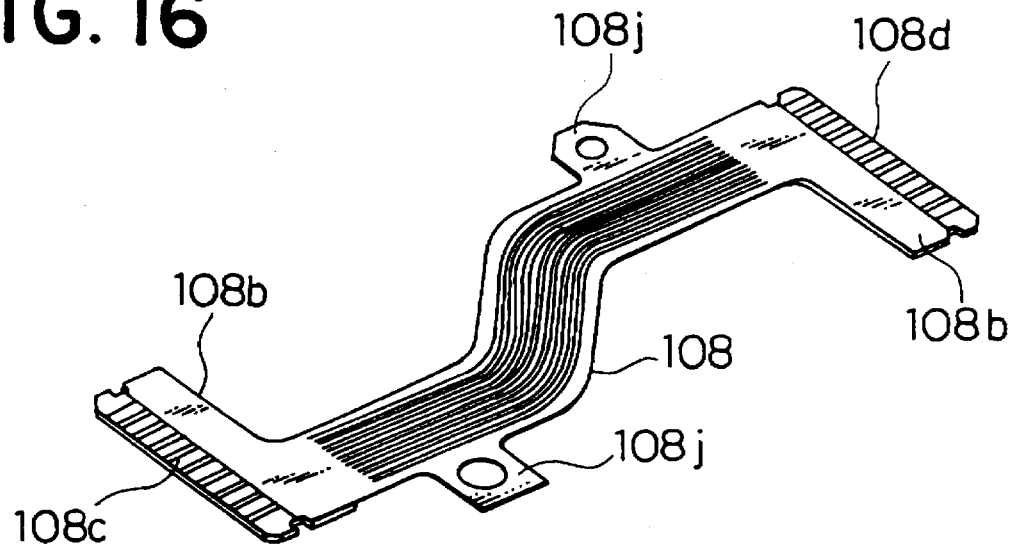
FIG. 16 is a perspective view showing the other of the flexible printed circuit boards forming the hinge connector according to the second preferred embodiment.
Figure 17:
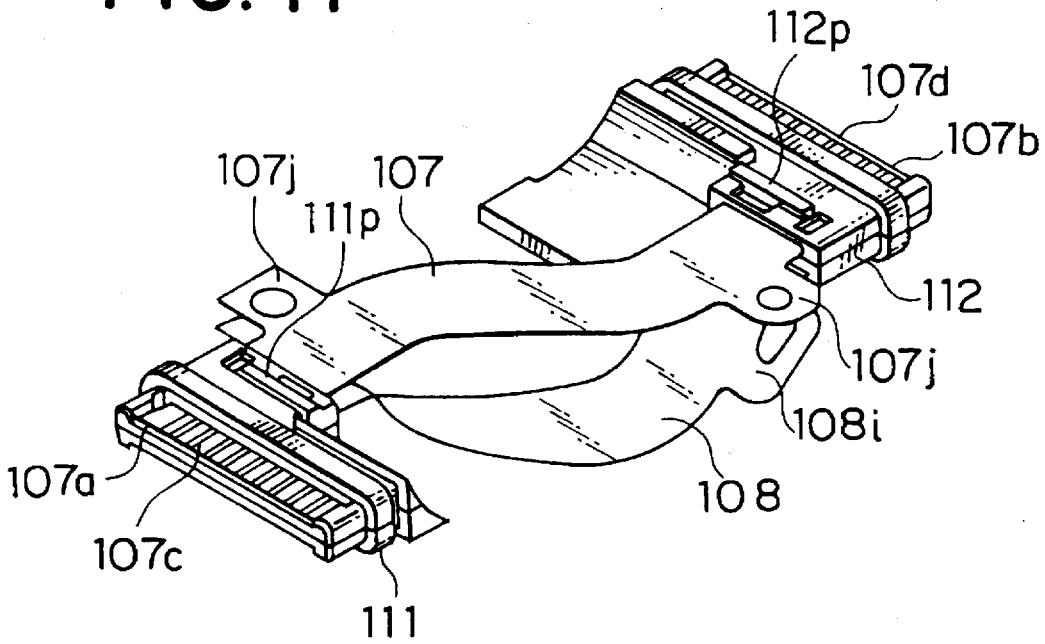
FIG. 17 is a perspective view showing a unit of the flexible printed circuit boards and fitting members coupled therewith, wherein the flexible printed circuit boards are not turned.

As shown in FIG. 16, the FPC 108 has connect portions 108*a* and 108*b* at its both ends. An intermediate portion extending between the connect portions 108*a* and 108*b* is flexible or bendable. The connect portion 108*a* is connected to the counterpart connector provided at the circuit section inside one of the boxes 1 and 2 shown in FIG. 1, for example, the box 2. On the other hand, the connect portion 108*b* is connected to the counterpart connector provided at the circuit section inside the other box 1. A number of contacts 108*c* and 108*d* are arranged at the connect portions 108*a* and 108*b* at given narrow pitches. As appreciated, the intermediate portion of the FPC 108 is provided with conductors for connection between the contacts 108*c* and 108*d*. As shown in FIGS. 11 and 17, the fitting member 111 unites the connect portions 107*a* and 108*a* by the mold-in forming with the contacts 107*c* and 108*c* being exposed.

Similarly, the fitting member 112 unites the connect portions 107*b* and 108*b* by the mold-in forming with the contacts 107*d* and 108*d* being exposed.

The contacts 107*c* at the connect portion 107*a* and the contacts 108*c* at the connect portion 108*a* are coupled to the fitting member 111 so as to face outward relative to each other. Similarly, the contacts 107*d* at the connect portion 107*b* and the contacts 108*d* at the connect portion 108*b* are coupled to the fitting member 112 so as to face outward relative to each other.

Figure 18A:
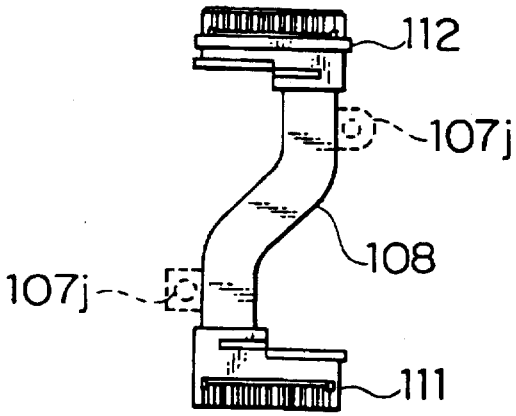
Figure 18B:
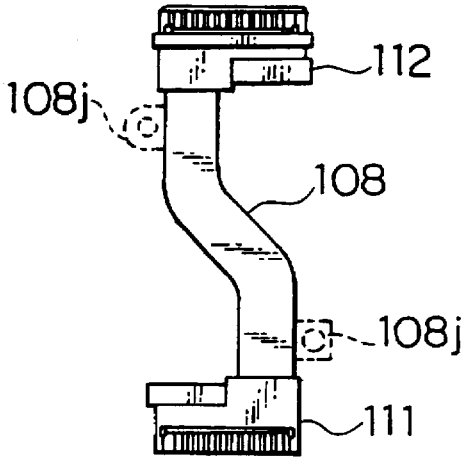

The FPC' 107 and 108 along with the fitting members 111 and 112 are press-fitted in the receiving sections 152 and 162, with carrier pieces 107*j* and 108*j* having been cut off as shown in FIGS. 18A and 18B.

Figure 14A:
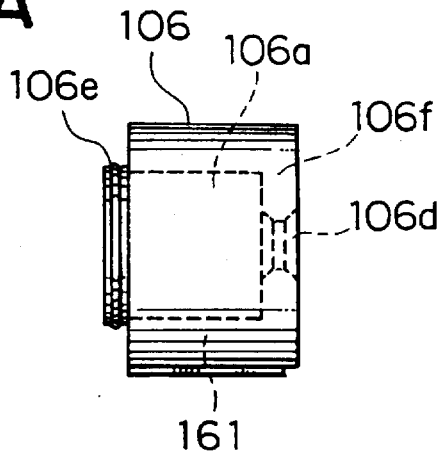
Figure 14B:
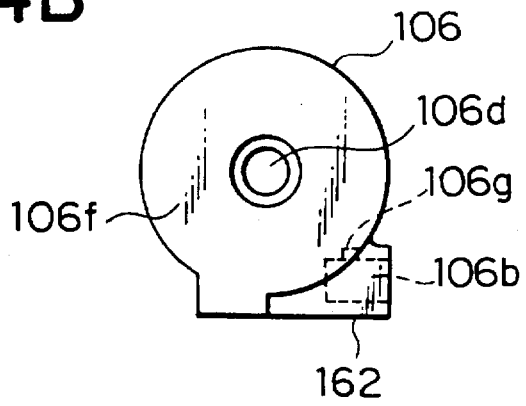
Figure 14C:
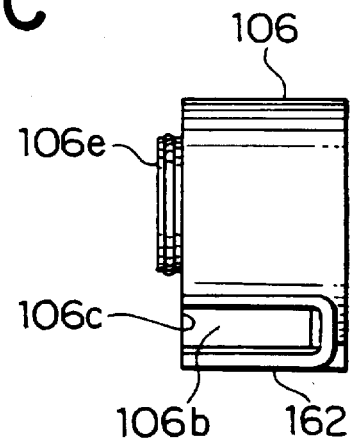

As shown in FIGS. 11 and 12B, a guide groove 105*g* is formed at an open side of the tubular section 151 facing the receiving space 105*b* for guiding the press-fit insertion of the fitting member 111. Into this guide groove 105*g*, an elongate projection 111*p* formed on a side of the fitting member 111 confronting the guide groove 105*g* is fitted. Similarly, as shown in FIG. 14B, a guide groove 106*g* is formed at an open side of the tubular section 161 facing the receiving space 106*b* for guiding the press-fit insertion of the fitting member 112. Into this guide groove 106*g*, an elongate projection 112*p* formed on a side of the fitting member 112 confronting the guide groove 106*g* is fitted.

After the fitting members 111 and 112 are press-fitted in the tubular members 105 and 106, they are firmly coupled by welding or bonding.

Figure 19:
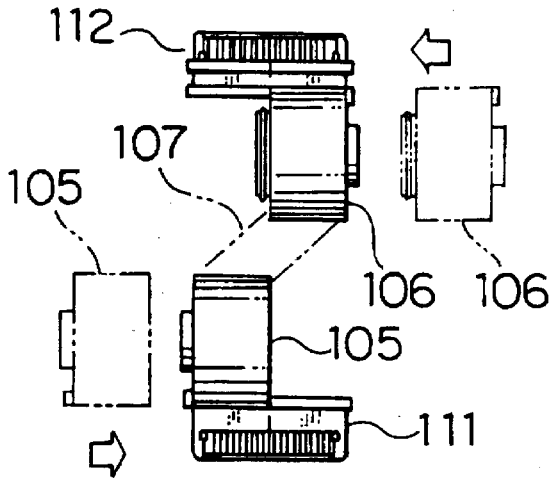
FIG. 19 is a diagram for explaining assembling of the hinge connector shown in FIG. 11.

The FPC's 107 and 108 are mounted in the tubular members 105 and 106 while the intermediate portions thereof are bent or turned as shown in FIGS. 11 and 19. In this mounted state, the intermediate portions of the FPC's are received in the hollow portions 105*a* and 106*a* of the tubular members 105 and 106. In this mounted state, the FPC's 107 and 108 rotate with the hollow portions 105*a* and 106*a* within these hollow portions 105*a* and 106*a*. Each of the FPC's 107 and 108 may be replaced with the FFC or the like.

Figure 20:
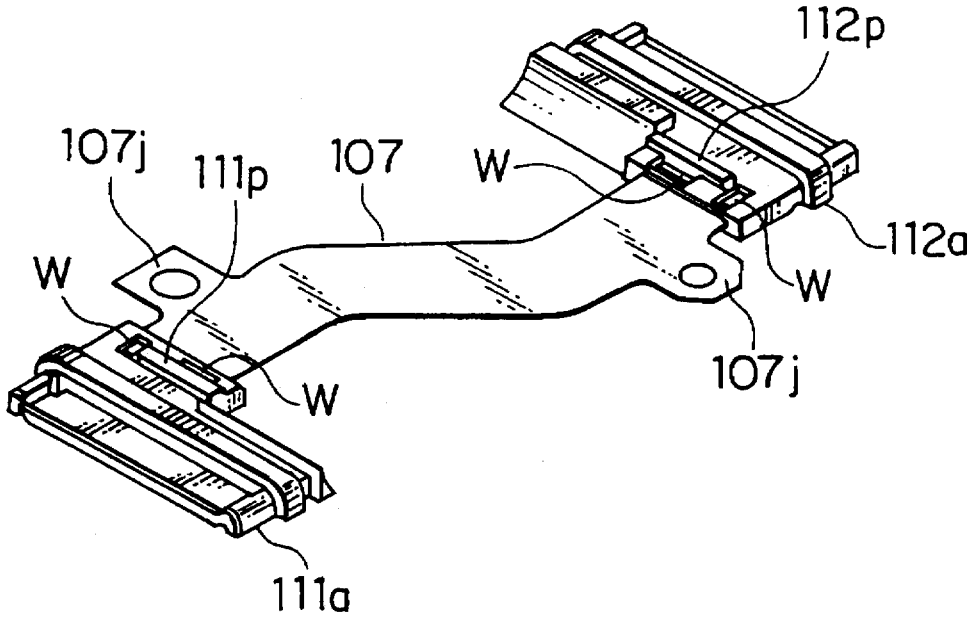
FIG. 20 is a perspective view showing a modification of the hinge connector, wherein one-side fitting members are coupled to the flexible printed circuit board shown in FIG. 15.
Figure 21A:
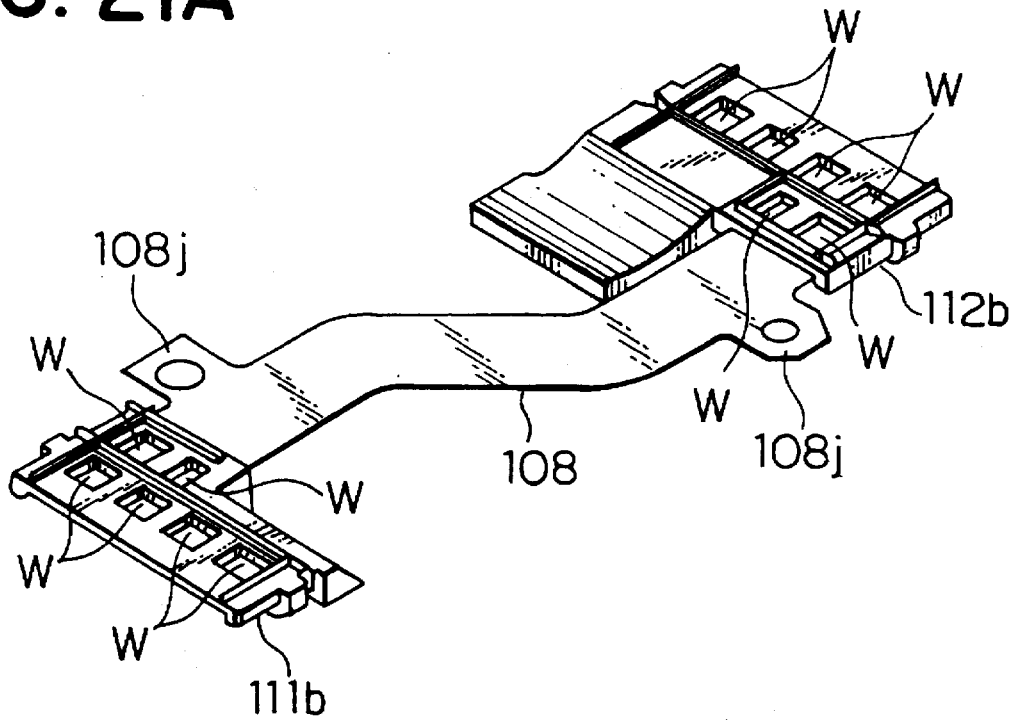
Figure 21B:
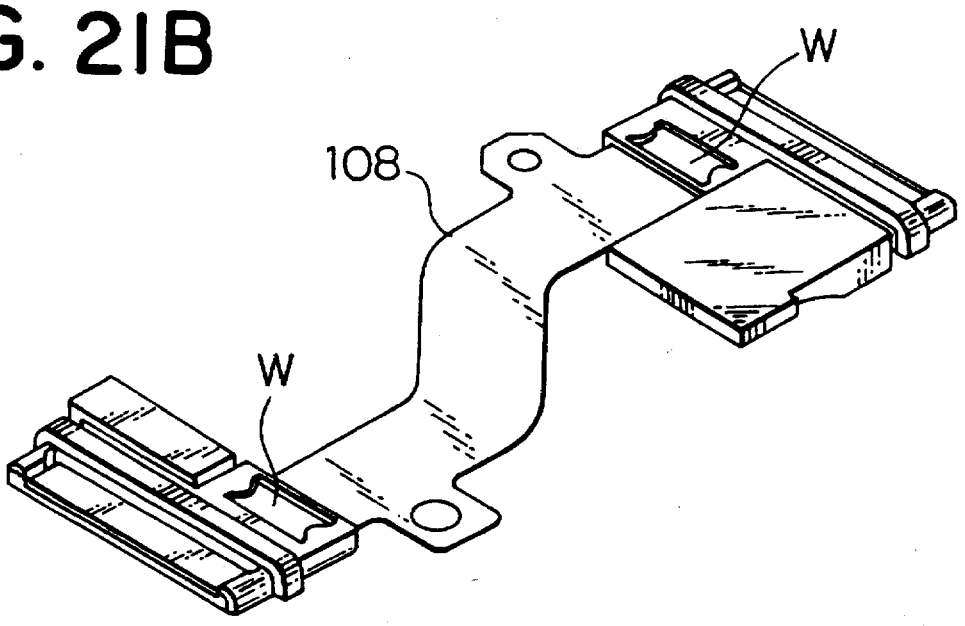

FIGS. 20, 21A and 21B show a modification of the fitting members 111 and 112. In this modification, the fitting member 111 includes a one-side fitting member 111*a* which is mold-in formed with the connect portion 107*a* of the FPC 107, and a one-side fitting member 111*b* which is mold-in formed with the connect portion 108*a* of the FPC 108. Similarly, the fitting member 112 includes a one-side fitting member 112*a* which is mold-in formed with the connect portion 107*b* of the FPC 107, and a one-side fitting member 112*b* which is mold-in formed with the connect portion 108*b* of the FPC 108.

By matching the one-side fitting members 111*a* and 111*b* and welding or bonding them, the fitting member 111 as shown in FIG. 17 is achieved. Similarly, by matching the one-side fitting members 112*a* and 112*b* and welding or bonding them, the fitting member 112 as shown in FIG. 17 is achieved.

Mounting of these fitting members to the tubular members 105 and 106 is the same as described above. In FIGS. 20, 21A and 21B, W represents a recessed portion where the welding or bending is performed.

Figure 22A:
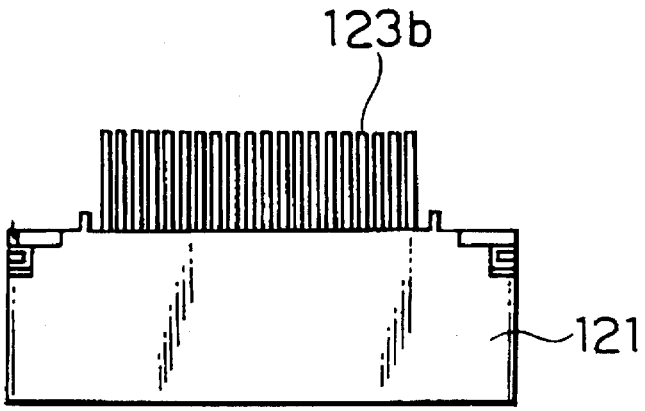
Figure 22B:
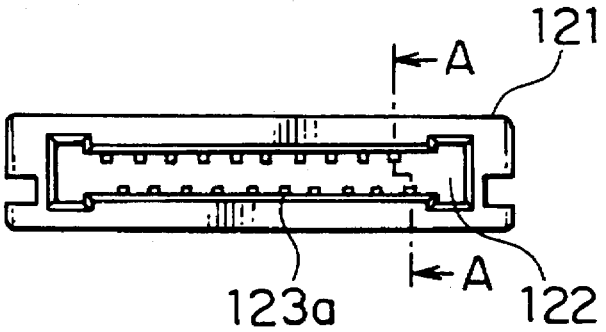
Figure 22C:
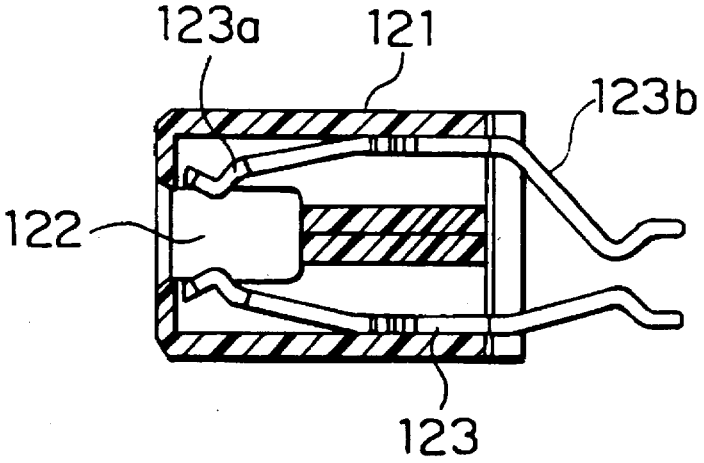

FIGS. 22A, 22B and 22C show the counterpart connector to be coupled with each of the fitting members 111 and 112. The counterpart connector includes an insulator 121 where a fitting portion 122 in the form of a large groove for receiving the fitting member 111 or 112 and a contact portion 123 are provided. The contact portion 123 includes contacts 123*a* for one-by-one contact with the contacts 107*c*, 108*c* or 107*d*, 108*d* and terminals 123*b*. The terminals 123*b* are connected to the circuit section provided within the box 1, 2 shown in FIG. 1.

While the present invention thus far been described in connection with a few embodiments thereof, it will readily be possible for those skilled in the art to put this invention into practice in various other manner. For example, the hinge connector is usable to various electronic device, such as a portable telephone or a personal computer.

What is claimed is:

1. A hinge connector comprising:

a first tubular member having a first tubular section and a first fitting section, said first tubular section with a first width having a first hollow portion, said first fitting section having a first receiving space for receiving a first counterpart connector;

a second tubular member having a second tubular section with a second width and a second fitting section, said first and said second tubular sections being rotatingly coupled to each other on a common axis so that said first and said second tubular members are turnable relative to each other around said common axis, said second tubular section having a second hollow portion, said second fitting section having a second receiving space for receiving a second counterpart connector; and a flexible conductor arranged in said first and said second hollow portions, said flexible conductor having at its one end a first connect portion wider than said first width and disposed in said first receiving space and connected to said first counterpart connector and at its other end said flexible conductor having a second connect portion wider than said second width and disposed in said second receiving space and connected to said second counterpart connector, said first connect portion extending parallel to said common axis and at least partially opposite said second tubular section, said second connect portion extending parallel to said common axis and at least partially opposite said first tubular section.

2. A hinge connector as claimed in claim 1, wherein a sealing member is provided in said first tubular member for sealing between said first tubular section and said first fitting section and wherein a sealing member is provided in said second tubular member for sealing between said second tubular section and said second fitting section.

3. A hinge connector as claimed in claim 2, wherein each of said sealing members is a packing.

4. A hinge connector as claimed in claim 2, wherein each of said sealing members is formed of an adhesive.

5. A hinge connector comprising:

a first tubular member having a first tubular section with a first width and a first receiving space, said first tubular section having a first hollow portion, said first receiving space receiving a first fitting member to be engaged with a first counterpart connector;

a second tubular member having a second tubular section with a second width and a second receiving space, said first and said second tubular sections being coupled to each other on a common axis so that said first and said second tubular members are turnable relative to each other around said common axis, said second tubular section having a second hollow portion, said second receiving space receiving a second fitting member to be engaged with a second counterpart connector; and a flexible conductor arranged in said first and said second hollow portions, said flexible conductor having at its one end a first connect portion wider than said first width and coupled with said first fitting member and at its other end said flexible conductor having a second connect portion wider than said second width and having conductive contacts to be connected to said first and said second counterpart connectors, respectively, said first connect portion extending parallel to said common axis and at least partially opposite said second tubular section, said second connect portion extending parallel to said common axis and at least partially opposite said first tubular section, said conductive contacts being arranged parallel to said common axis on each of said first and said second connect portions.

6. A hinge connector as claimed in claim 5, wherein said first and said second fitting members are provided at said first and said second connect portions by mold-in forming.

7. A hinge connector as claimed in claim 5, wherein said flexible conductor includes first and second conductor members, each of said first and said second conductor members having said first and said second connect portions, wherein each of said first connect portions has a first one-side fitting member and each of said second connect portions has a second one-side fitting member, and wherein said first fitting member is formed by matching and coupling said first one-side fitting members and said second fitting member is formed by matching and coupling said first one-side fitting members and said second fitting member is formed by matching and coupling said second one-side fitting members.

8. A hinge connector as claimed in claim 7, wherein said first one-side fitting members are coupled with each other by one of welding or bonding and said second one-side fitting members are coupled with each other by one of welding or bonding.

9. A hinge connector comprising:

a first tubular member with a first width having a first hollow portion and a first receiving space extending outwardly from said first hollow portion;

a second tubular member with a second width having a second hollow portion and a second receiving space extending outwardly from said second hollow portion, said first and said second tubular member being coupled to each other on a common axis so that said first and said second tubular members are turnable relative to each other around said common axis to provide a hinge action; and a flexible conductor extending between said first and said second receiving spaces via said first and said second hollow portions;

a first connect portion wider than said first width and connected to said flexible conductor and located in said first receiving space for enabling a connection to a first counterpart connector, said first connect portion extending parallel to said common axis and at least partially opposite said second tubular member; and a second connect portion wider than said second width and connected to said first flexible conductor and located in said second receiving space for enabling a connection to a second counterpart connector, said second connect portion extending parallel to said common axis and at least partially opposite said first tubular member.

10. A hinge connector as claimed in claim 9, wherein said first tubular member comprises a first tubular section and a first fitting section connected to an outer peripheral surface of said first tubular section, said first tubular section defining said first hollow portion, said first fitting section defining said first receiving space and providing space for said first counterpart connector to enable said first counterpart connector to be connected to said first connect portion within said first receiving space, and wherein said second tubular member comprises a second tubular section and a second fitting section connected to an outer peripheral surface of said second tubular section, said second tubular section defining said second hollow portion, said second fitting section defining said second receiving space and fitting over said second counterpart connector to enable said second counterpart connector to be connected to said second connect portion within said second receiving space.

11. A hinge connector as claimed in claim 9, wherein said first tubular member comprises a first tubular section and a first receiving section connected to an outer peripheral surface of said first tubular section, said first tubular section defining said first hollow portion, said first receiving section defining said first receiving space, said first connect portion being received in said first receiving space for coupling to said first counterpart connector, and wherein said second tubular member comprises a second tubular section and a second receiving section connected to an outer peripheral surface of said second tubular section, said second tubular section defining said second hollow portion, said second receiving section defining said second receiving space, said second connect portion being received in said second receiving space for coupling to said second counterpart connector.

* * * * *

UNITED STATES PATENT AND TRADEMARK OFFICE

CERTIFICATE OF CORRECTION

| | |
|---|---|
| PATENT NO. : | 5,681,176 |
| DATED : | October 28, 1997 |
| INVENTOR(S) : | Kazuaki Ibaraki; Katsuma Ushijima; Michio Nagai; Yuichi Morita; Koji Umeda |

It is certified that error appears in the above-indentified patent and that said Letters Patent is hereby corrected as shown below:

Column 8, Line 44,
after section, insert --with a first width--

Signed and Sealed this

Seventeenth Day of March, 1998

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,681,176
DATED : October 28, 1997
INVENTOR(S) : Kazuaki Ibaraki; Katsuma Ushijima; Michio Nagai; Yuici Morita; Koji Umeda It is certified that error appears in the above-identified patent and that said Letters Patent is hereby corrected as shown below:

Title Page:
[73] add --Japan Aviation Electronics Industry Limited--

Title Page:
Attorney, Agent or Firm should read --Laff, Whitesel & Saret, Ltd.,
J. Warren Whitesel--

Signed and Sealed this

Eighth Day of May, 2001

*Attest:*

Nicholas P. Godici

NICHOLAS P. GODICI

*Attesting Officer*

*Acting Director of the United States Patent and Trademark Office*